US007685658B2

(12) United States Patent
Lokhorst et al.

(10) Patent No.: US 7,685,658 B2
(45) Date of Patent: Mar. 30, 2010

(54) BODY SUPPORT APPARATUS HAVING AUTOMATIC PRESSURE CONTROL AND RELATED METHODS

(75) Inventors: David M. Lokhorst, Victoria (CA); Colin Clarke, Victoria (CA)

(73) Assignee: Nitta Corporation, Nara (JP)

( * ) Notice: Subject to any disclaimer, the term of this patent is extended or adjusted under 35 U.S.C. 154(b) by 508 days.

(21) Appl. No.: 11/568,511

(22) PCT Filed: May 2, 2005

(86) PCT No.: PCT/CA2005/000658

§ 371 (c)(1), (2), (4) Date: Oct. 30, 2006

(87) PCT Pub. No.: WO2005/104904

PCT Pub. Date: Nov. 10, 2005

(65) Prior Publication Data

US 2008/0005843 A1 Jan. 10, 2008

Related U.S. Application Data

(60) Provisional application No. 60/567,215, filed on Apr. 30, 2004.

(51) Int. Cl.
*A61G 7/057* (2006.01)

(52) U.S. Cl. ..... 5/424; 5/713; 5/715

(58) Field of Classification Search ..... 5/424, 5/713, 715
See application file for complete search history.

(56) References Cited

U.S. PATENT DOCUMENTS

| | | | | | |
|---|---|---|---|---|---|
| 4,989,283 | A * | 2/1991 | Krouskop | 5/713 |
| 5,062,169 | A * | 11/1991 | Kennedy et al. | 5/713 |
| 5,170,364 | A * | 12/1992 | Gross et al. | 702/139 |
| 5,815,864 | A * | 10/1998 | Sloop | 5/706 |
| 6,009,580 | A * | 1/2000 | Caminade et al. | 5/713 |
| 6,034,526 | A * | 3/2000 | Montant et al. | 324/207.19 |
| 6,058,537 | A * | 5/2000 | Larson | 5/710 |
| 6,079,068 | A * | 6/2000 | Viard | 5/671 |
| 2001/0039681 | A1 * | 11/2001 | Johnson et al. | 5/713 |
| 2008/0005843 | A1 * | 1/2008 | Lokhorst et al. | 5/655.3 |

FOREIGN PATENT DOCUMENTS

WO WO 2004006768 A1 * 1/2004

* cited by examiner

*Primary Examiner*—Michael Trettel
(74) *Attorney, Agent, or Firm*—Oyen Wiggs Green & Mutala LLP

(57) ABSTRACT

A body support such as a cushion, mattress, chair or the like has at least one inflatable air chamber. A pressure sensor senses interface pressures at different locations on a surface of the air chamber. Indicators derived from the interface pressures indicate the onset of a trend toward bottoming out. A controller controls air pressure within the air chamber based at least in part on values of the indicators. The controller may be implemented as a state machine.

24 Claims, 12 Drawing Sheets

BODY SUPPORT APPARATUS HAVING AUTOMATIC PRESSURE CONTROL AND RELATED METHODS

CROSS-REFERENCE TO RELATED APPLICATION

For purposes of the United States of America, this application claims the benefit under 35 U.S.C. §119 of U.S. application No. 60/567,215, entitled PRESSURE RELIEF SUPPORT SURFACE, filed Apr. 30, 2004.

TECHNICAL FIELD

The invention relates to apparatus for supporting a person's body or a part of a person's body. The invention may be embodied, for example, in mattresses, seat cushions, or the like.

BACKGROUND

Support surfaces such as mattresses and seat cushions that include air chambers have application for supporting people who are bed-ridden, confined to a chair or the like. A wide range of air mattresses and air cushions are suggested in the patent literature. Some such air mattresses and air cushions include controllers that control the operation of pumps and/or valves to inflate or deflate the air chambers and thereby automatically provide a required degree of support while reducing pressure points and the like.

In general it is desirable to minimize the interface pressure between the person and support surface. By doing so one can improve the health and comfort of the occupant. However, if the air pressure is too low then the person may "bottom out". This is undesirable as bottoming out can be uncomfortable for the occupant and can even negate the benefit that the support surface is intended to provide.

Patents in the field of cushions or mattresses that include inflatable chambers include: U.S. Pat. No. 4,799,276; U.S. Pat. No. 6,721,980; U.S. Pat. No. 4,949,412; and U.S. Pat. No. 5,283,735. U.S. Pat. No. 4,554,930; U.S. Pat. No. 6,030,351 and U.S. Pat. No. 5,253,656 show pressure sensors for use on a bed or the like. U.S. Pat. No. 6,058,537 shows an air mattress with sensors for determining the location of a person. U.S. Pat. No. 5,237,501; U.S. Pat. No. 6,034,526; U.S. Pat. No. 5,539,942; U.S. Pat. No. 4,542,547 and U.S. Pat. No. 6,870,341 disclose related technologies. Other patient supports are disclosed in U.S. Pat. No. 5,630,238 U.S. Pat. No. 5,715,548; U.S. Pat. No. 6,076,208; U.S. Pat. No. 6,240,584; U.S. Pat. No. 6,320,510; U.S. Pat. No. 6,378,152; and U.S. Pat. No. 6,499,167.

Some existing systems have controllers that control the air pressure in the air chambers. In some cases, such controllers determine the pressure of air to maintain in the air chambers based upon the weight of the occupant. Existing systems may require an attendant to enter the desired air pressure, or to enter the occupant's weight. Other existing systems automatically determine the air pressure based on feedback from weight sensors which measure the weight of the occupant.

Such existing systems have several shortcomings. One shortcoming is that the air pressure is determined largely on the basis of the occupant's weight. However, different persons of similar weight may have vastly different body shapes. Consider, for example, a 200 lb, 6'-3" tall man versus a 200 lb, 4'-11" tall woman. Although in reality the air pressure that minimizes the interface pressure between the support surface and the occupant is different for each occupant, existing systems cannot automatically accommodate such differences because the necessary sensory inputs are not available.

Another shortcoming of the existing systems is that user interaction is required to set up the air pressure. For example, a user (typically a nurse) may enter the occupant's weight. Alternatively, the user may be required to "tare" the system while the support surface is unoccupied, in order for it to subsequently determine the occupant's weight with the required accuracy.

Other existing systems control the air pressure based on the measurement of the interface pressure between the support surface and the occupant (see for examples U.S. Pat. No. 4,799,276; U.S. Pat. No. 6,721,980, and U.S. Pat. No. 5,283,735). In these systems, the air pressure may be regulated so that the interface pressure between the occupant and the support surface does not exceed a predetermined threshold. In general these systems suffer from the shortcoming that the presence of the sensors required to measure the interface pressure itself causes detrimental interface pressures.

There remains a need for support surfaces that alleviate or overcome these shortcomings.

SUMMARY OF THE INVENTION

Some aspects of the invention provide body support surfaces. One aspect provides support surfaces having an inflatable air chamber and a plurality of pressure-sensitive taxels underlying the air chamber. Each of the taxels provides an output indicative of a pressure exerted by the air chamber on a substrate underlying the air chamber at a location of the taxel. Another aspect provides body support surfaces having: an inflatable air chamber and a plurality of pressure-sensitive taxels distributed over a two-dimensional area to sense interface pressures exerted by the air chamber. Each of the taxels provides an output indicative of a pressure exerted by the air chamber at the location of the taxel. Another aspect provides a method for controlling fluid pressure within an air chamber of a body support surface. The method comprises monitoring interface pressures of the air chamber at a plurality of spaced-apart locations and monitoring for a trend toward bottoming out by monitoring for non-uniformities of the taxel values.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
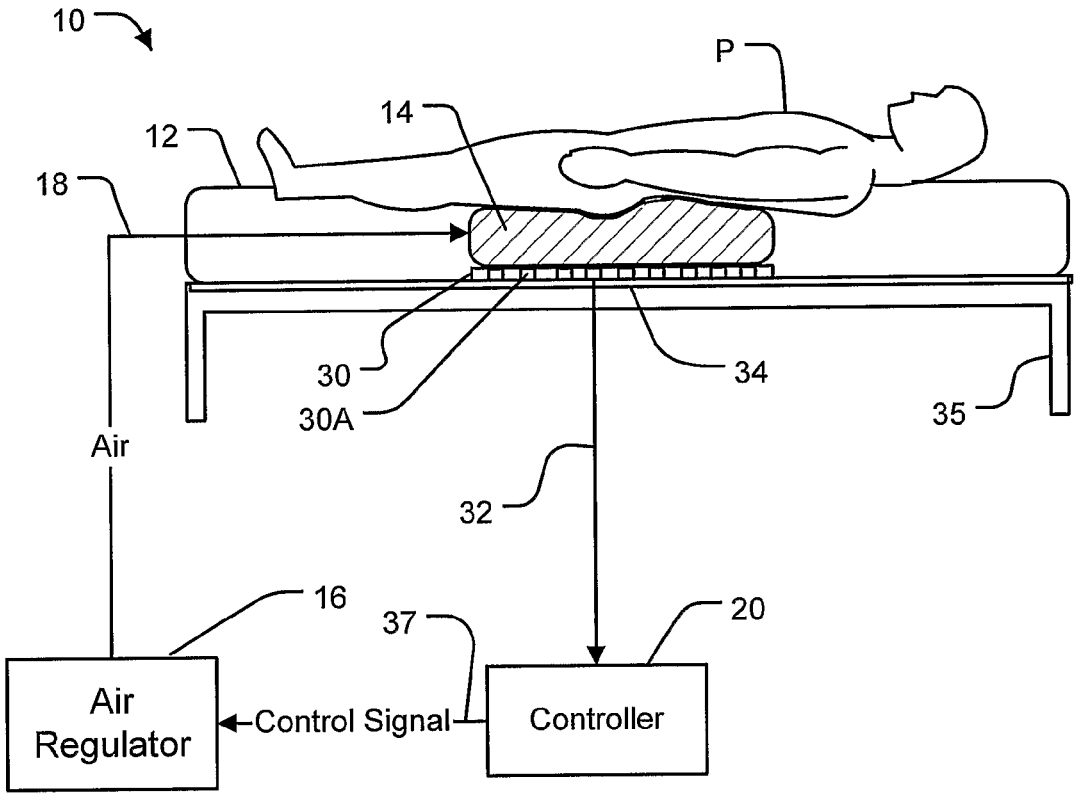
FIG. 1 is a block diagram of apparatus according to an embodiment of the invention.

The invention provides air support apparatus and methods. FIG. 1 shows an example apparatus 10 according to the invention. Apparatus 10 comprises a support surface 12 that includes at least one air chamber 14. Air chamber 14 provides support for a person P or for a part of the person's body. An air regulator 16 controls the introduction into air chamber 14 and/or the exit from air chamber 14 of air (or other suitable gas). A controller 20 operates air regulator 16 to control the pressure within air chamber 14.

Air chamber 14 may comprise a suitable bladder, for example and preferably has walls that do not stretch significantly at the normal operating pressures experienced by air chamber 14.

System 10 includes a pressure sensor 30 that provides signals 32 that carry information regarding a distribution of pressure on pressure sensor 30 caused by an occupant P. Controller 20 receives signals 32 from pressure sensor 30. In the illustrated embodiment, pressure sensor 30 is disposed underneath air chamber 14.

Pressure sensor 30 may be disposed on a substrate 34 supported by a bed frame 35 for example. It is preferable but not mandatory that pressure sensor 30 be disposed on a hard or firm surface such as a layer of high density foam, a board, or the like. If body support 10 is not required to articulate, then the substrate is preferably a hard material (such as wood or a rigid plastic). If support 10 is required to articulate, then the substrate may be a firm but flexible material, such as a high-density foam or semi-rigid plastic.

Pressure sensor 30 preferably measures a distribution of pressure over a surface beneath person P. For example, pressure sensor 30 may comprise a plurality of spatially-distributed pressure sensing elements 30A. Pressure sensing elements 30A may be called "taxels" (shorthand for "tactile elements"). The taxels are preferably spaced evenly in the area that underlies the portion of person P being supported (e.g. the person's mid-section in FIG. 1). Taxels 30A may, for example, be arranged in a regular array.

The taxels of pressure sensor 30 are capable of detecting variations of pressure in an expected range. The forces acting on pressure sensor 30 will be directly related to the weight of the person P and the support area over which the person's weight is distributed. When the support area is large (as occurs, for example, when a person is lying on a bed) the expected pressures are in the range of approximately 0.05 to 0.2 pounds per square inch (roughly 300 to 1,500 Newtons/$M^2$). If the support surface is relatively small (for example, the seat of a chair) the expected pressures could be, for example, in the range of about 0.5 to 2.0 pounds per square inch (roughly 3000 to 15,000 Newtons/$M^2$).

Pressure sensor 30 may, for example, comprise a pressure sensor of the type described in Lokhorst et al. (PCT international patent application publication WO 2004/006768). Such sensors are available under the brand name KINOTEX™ from Tactex Controls Inc. of Victoria, Canada.

Figure 1A:
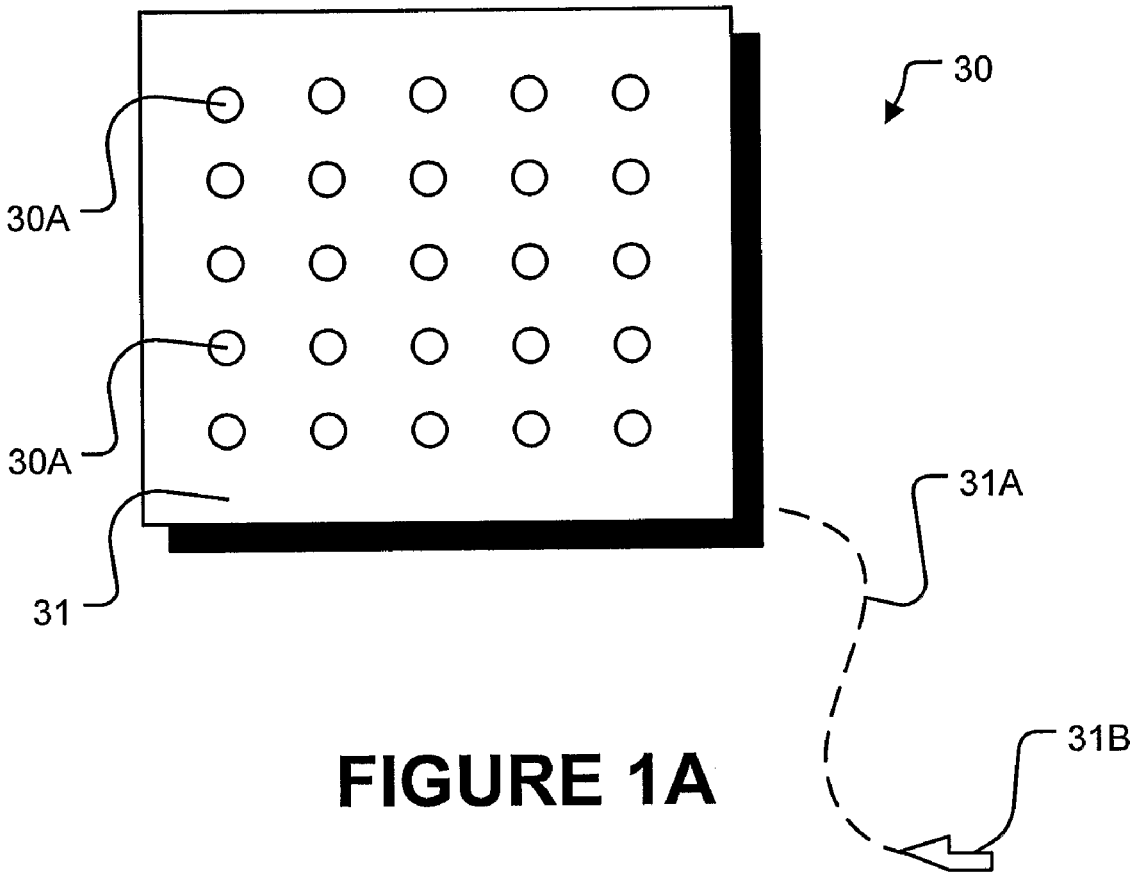
FIG. 1A is a plan view of a pressure sensor.

Pressure sensor 30 may be provided in the form of a separate assembly lying between air chamber 14 and substrate 34 (or optionally lying between substrate 34 and another substrate (not shown) or bed frame 35). FIG. 1A shows an example of a pressure sensor 30 in the form of a mat 31 that may be disposed under an air chamber 14. A connecting cable 31A is provided to deliver signals 32 (not shown in FIG. 1A) representing pressures sensed by taxels 30A to controller 20. A connector 31B is provided to plug cable 31A into controller 20.

In the alternative, pressure sensor 30 may be integrated with the lower face of air chamber 14 or integrated with substrate 34. What is required is that pressure sensor 30 be disposed to detect a pattern of pressure applied by air chamber 14 to the underlying substrate that supports air chamber 14. As described below, it is also possible to provide an interface pressure sensor above air chamber 14.

Taxels 30A preferably each measure the interface pressure at a particular location and respond (i.e. provide output) generally in proportion to that interface pressure. Taxels 30A are preferably spaced evenly within the area under air chamber 14. In preferred embodiments, pressure sensor 30 has taxels that are distributed over a two-dimensional area. For example, the pressure sensing mat 31 of FIG. 1A has taxels 30A distributed over an area that has similar dimensions of length and width. Pressure sensor may include at least four taxels spaced apart in each of two dimensions. For example, the mat 31 of FIG. 1A has a 5×5 array of taxels. In some embodiments there may be 30 or 40 or more taxels that sense the interface pressure over an area of an air chamber.

The number and spacing of taxels 30A can be varied depending upon the specific shape, size, and bottom configuration of air chamber 14. For air chambers that have generally flat bottoms, the inventors have found that a regular arrangement of taxels 30A, spaced in the range of about 1" (2½ cm) and 4" (10 cm) apart, is preferable. For air chambers that assume more 3-dimensionally shaped bottoms when inflated (for example, air chambers that are cylindrical in cross-section or ribbed on their surface that contacts pressure sensor 30) it is preferable to arrange taxels 30A such that the bottom of the air chamber is in contact with taxels 30A at all air pressures. For example, if a lower surface of the air chamber is ribbed, taxels may be arranged along ribs of the air chamber.

Air regulator 16 may comprise any practical system that can be operated to maintain an air pressure within air chamber 14 at a desired value under the control of controller 20. Air regulator 16 may have any of a wide range of different structures. For example, air regulator 16 may comprise:

- a pump that can be controlled directly or indirectly by controller 20 to provide a desired air pressure at its output;
- a pump that continuously delivers air to air chamber 14, for example at a constant rate or at a constant pressure, and a valve that is controlled directly or indirectly by controller 20 to vary a rate at which air can escape from air chamber 14;
- a controller that releases predetermined quantities of relatively high pressure air into air chamber 14 coupled with a valve that can be opened to allow air to escape from air chamber 14 or a valve that allows air to escape continuously from air chamber 14;
- combinations of the above; or, the like.

Controller 20 may comprise a suitably programmed data processor such as a programmable controller, a programmed computer, or the like together with interface electronics to permit control of air regulator 16. The data processor may run software instructions provided in firmware to perform methods of the invention. Controller 20 may also, or in the alternative, comprise dedicated electronic control circuits that implement suitable control algorithms or process data 32 for use in a control algorithm.

Controller 20 may include a suitable user interface that permits a user to perform functions such as turning system 10 on or off, viewing information regarding the status of system 10 and/or adjusting the operation of system 10.

Pressure sensor 30 provides pressure distribution data 32 to controller 20. Pressure distribution data 32 is essentially a map of the interface pressure between the bottom of air chamber 14 and substrate 34. Controller 20 controls air regulator 16 to cause the pressure within air chamber 14 to have a value that is determined by controller 20 at least in part on the basis of pressure distribution data 32.

Figure 1B:
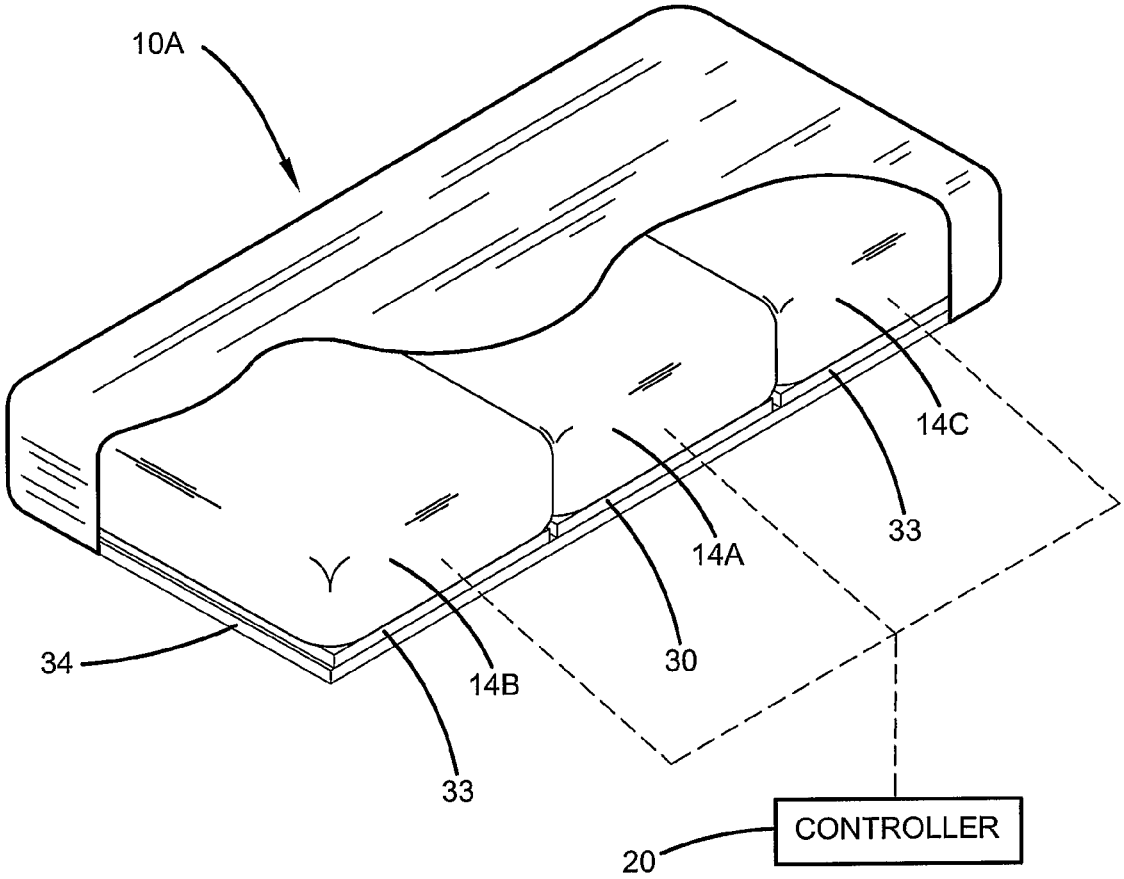
FIG. 1B is a perspective view of an air mattress incorporating a pressure sensor.

FIG. 1B is a perspective partially cut-away view of an air mattress 10A. Mattress 10A comprises three air chambers 14. A first air chamber 14A is located in a central region of mattress 10A to underlie an occupant's mid-section. A second air chamber 14B is located to underlie the occupant's torso and head. A third air chamber 14C is located to underlie the occupant's feet.

In a mattress such as mattress 10A it is desirable to provide three (or more) air chambers because, in general, a higher air pressure is required in the mid-section (air chamber 14A) to support the occupant's weight. Somewhat lower air pressure (perhaps 80% of that of first air chamber 14A) may be provided in second air chamber 14B to support the occupant's torso, and even lower air pressure (perhaps 30% of that of first air chamber 14A) may be provided in third air chamber 14C to support the occupant's feet.

Figure 1C:
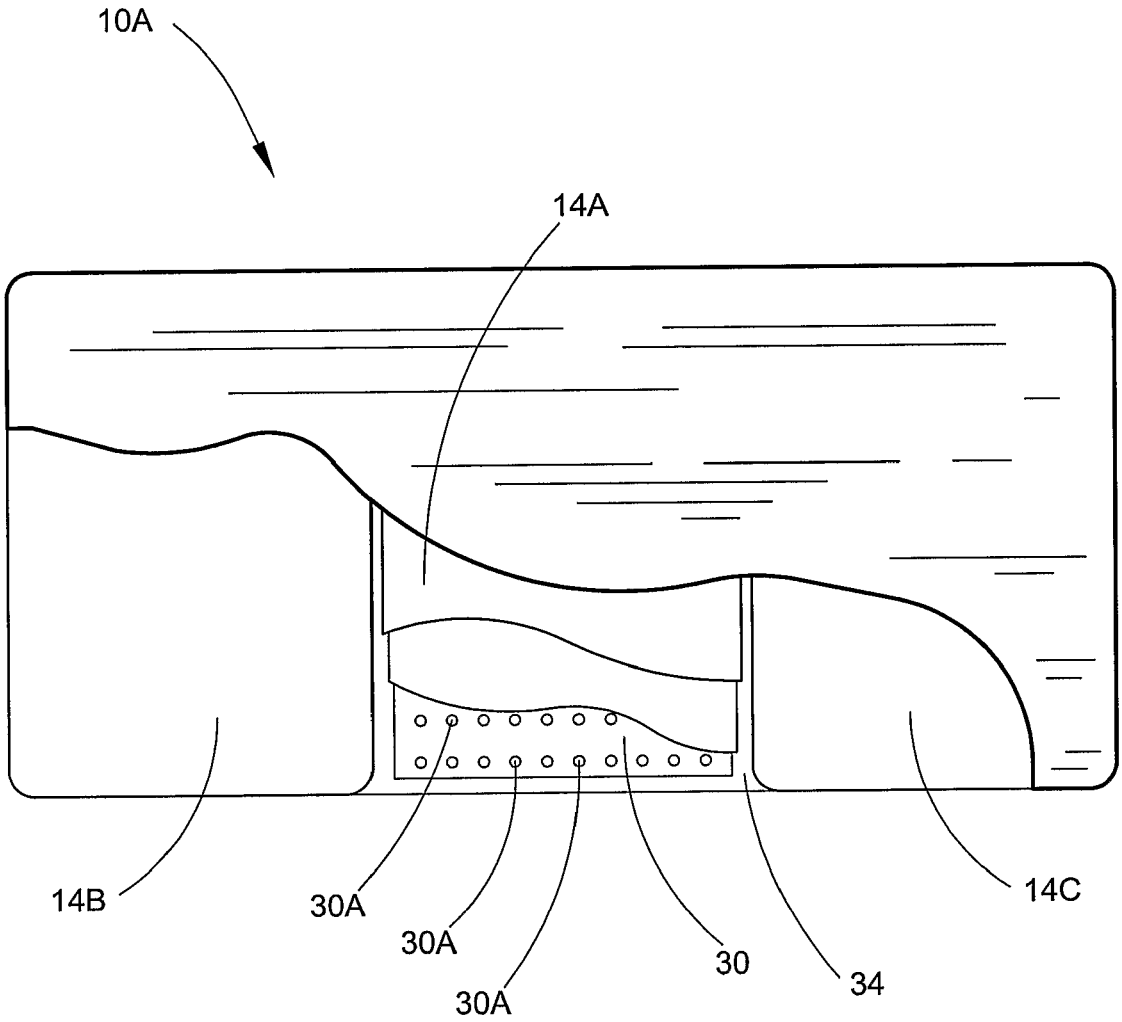
FIG. 1C is a partially cut-away top view of the mattress of FIG. 1B.

An interface pressure sensor 30 is located under first air chamber 14A. FIG. 1C shows mattress 10A from the top. The cover and first air chamber 14A have been partially cut away to show the alignment of first air chamber 14A to the underlying pressure sensor 30.

Pressure sensors 30 could optionally also be provided under one or both of second and third air chambers 14B and 14C. However, in the illustrated embodiment pressure sensor 30 is only provided under first air chamber 14A which would be expected to be most susceptible to bottoming out because it carries the majority of the occupant's weight. If necessary, spacers 33 that are equivalent in thickness to pressure sensor 30 may be provided under air chambers 14B and 14C. In the alternative, the second and third air chambers may be designed with thickness different to that of the first chamber or a pressure sensor 30 of a thin type may be used.

An automatic control system 20 may be configured to individually control the air pressure of each of the air chambers 14 by use of three air pressure regulators. The air pressure in first air chamber 10A may be controlled as described herein based upon signals 32 received from pressure sensor 30. Air pressures in second and third air chambers 14B and 14C may be kept at pressures that are functions of the pressure in first air chamber 14A (for example, the air pressures in the second and third air chambers may have fixed ratios to the pressure within the first air chamber). In this way, interface pressure sensors are not required under the second and third air chambers.

A substrate 34 is provided underneath the interface pressure sensor to prevent any small protrusions on the bed frame from causing the sensor to register spurious signals. The substrate is a firm material. If the mattress is not required to articulate, then the substrate is preferably a hard material (such as wood or a rigid plastic). If the mattress is required to articulate, then the substrate may be a flexible material, such as a high-density foam or semi-rigid plastic.

Figure 2:
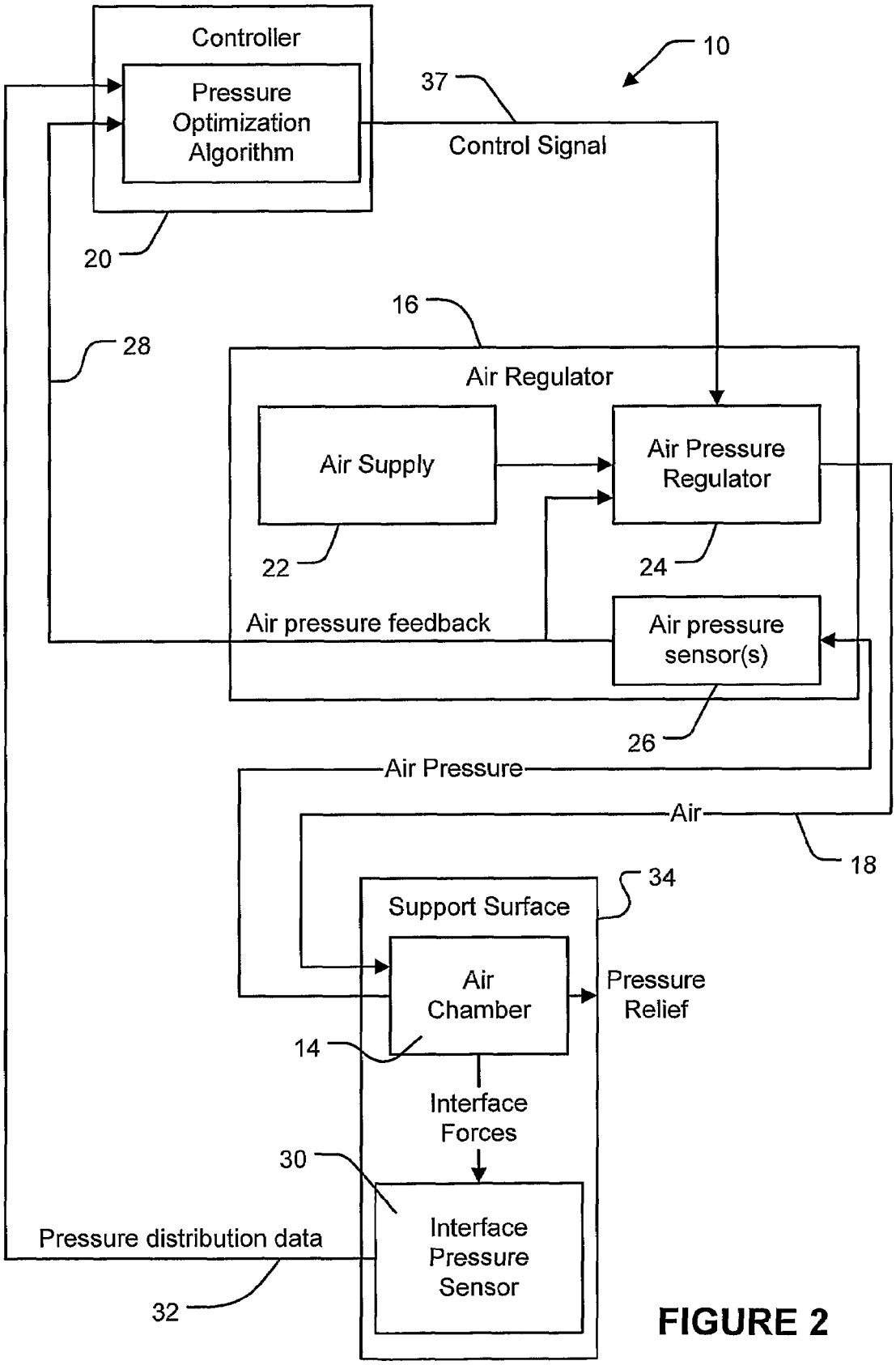
FIG. 2 is a block diagram showing a body support apparatus incorporating a specific control system.

FIG. 2 is a block diagram of a body support apparatus showing a particular control system. In the illustrated embodiment, air regulator 16 comprises a source 22 of air. Source 22 may comprise a reservoir containing compressed air, an air pump, air compressor or the like. Air is delivered from source 22 at a relatively high pressure to an air pressure regulator 24. Air pressure regulator 24 maintains the pressure within air line 18 which communicates with air chamber 14 at a value set in response to a control signal 37 from controller 20. An optional air pressure sensor 26 provides a signal 28 representing the air pressure within air chamber 14 to controller 20 and air pressure regulator 24.

Air pressure regulator 24 may comprise suitable control electronics or control mechanisms to maintain the air pressure within air chamber 14 at a set-point specified by controller 20. In the alternative, controller 20 may control components of air pressure regulator 24 directly. Any of a wide range of pressure regulator mechanisms may be provided in air pressure regulator 24.

One aspect of this invention comprises a method to operate apparatus, for example the apparatus of FIG. 1, to prevent person P from bottoming-out. Bottoming-out is a condition that occurs when a portion of the person is supported directly by the frame 35 of the bed or other substrate 34 underlying air chamber 14, rather than by a cushion of air provided by the support surface. The onset of a trend toward bottoming-out may be detected before bottoming out actually occurs by detecting trends toward:

- an increase in the maximum pressures detected at locations on pressure sensor 30; and,
- a decrease in the area supporting the occupant (i.e. a decrease in the area of pressure sensor 30 experiencing more than some minimum threshold pressure) The simultaneous occurrence of these events indicates that a greater portion of the occupant's weight is being supported by a smaller area. If this trend continues, it leads to bottoming-out.

In response to detecting a trend toward bottoming out, controller 20 may take action to prevent bottoming out and/or to operate apparatus 10 in a mode that is less susceptible to bottoming out.

Figure 3:
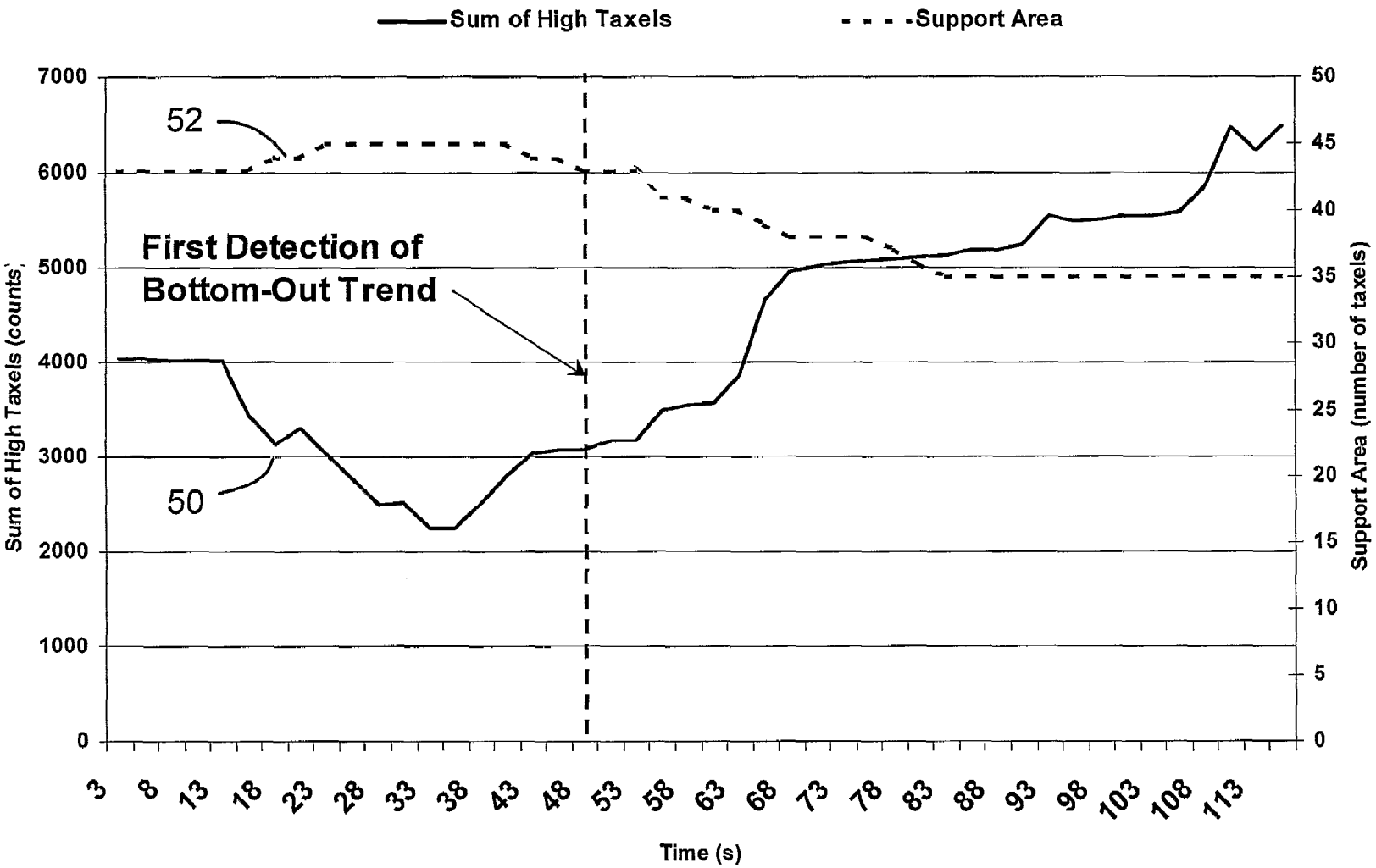
FIG. 3 is a graph showing the variations in two functions of pressure sensor outputs with time.

FIG. 3 is a chart showing example indicators that may be used to detect an increased risk of bottoming out according to a method of the invention. Curve 50 represents the sum of the pressures detected by those taxels of a pressure sensor 30 sensing a pressure equal to or in excess of a high pressure threshold (high-pressure taxels) as a function of time. Curve 52 shows the number of taxels in areas that are providing support for person P (i.e. the number of taxels sensing a pressure equal to or in excess of a low pressure threshold) as a function of time. In the time frame represented in the chart of FIG. 2, the air pressure in chamber 14, is initially at a higher value and is slowly reduced.

Curve 50 shows that the sum of pressures sensed by high pressure taxels (scale at left vertical axis) initially decreases and then tends to increase, while curve 52 shows a concomitant decrease in the number of taxels supporting the person (scale at right vertical axis). The vertical line indicates a time at which a method according to an example embodiment of the invention first detects a trend toward bottoming out.

Curves 50 and 52 are examples of "indicators" that may be used to identify the bottoming-out trend. Other indicators could be used in addition to or in the alternative to the indicators illustrated in FIG. 3. In general, the best indicator provides a statistical metric of the pressure distribution and is minimized (or maximised) when the air pressure in air chamber 14 is optimum. For example, some alternative indicators include:

- The sum of outputs of taxels over a "high pressure threshold". For this indicator, a threshold is set, and the amount by which the taxel values exceed this threshold is accumulated. The high-pressure threshold may be fixed, or preferably, it may be computed from time to time in proportion to the average taxel output. The inventors have found that it is preferable to set the high-pressure threshold in the range of 1.2 to 3.0 times the average of all taxel outputs.
- The sum of the amount by which those of the taxels having output values over a "high pressure threshold" exceed the high pressure threshold.
- The area not providing support, as measured by the number of taxels below a "support threshold" (this is equivalent to—i.e. contains the same information as—curve 50 of FIG. 2 except that the "area not providing support" decreases when the support area increases). The support threshold may be fixed, or preferably, the support threshold may be computed from time to time in proportion to the average taxel output. The inventors have found that it is preferable to set the support pressure threshold in the range of 0.1 to 0.7 times the average of all taxel outputs.
- The number of taxels over a threshold. This is similar to the first indicator described above. A high-pressure threshold is set, and the number of taxels that exceed that high-pressure threshold is counted.
- The maximum output reported by any given taxel;
- The average value of a number (e.g. three) taxels reporting the highest outputs.
- A measure of variance in the taxel outputs such as the standard deviation of all of the taxel outputs. This may be calculated in accordance with the usual formula in which standard deviation equals the square root of the sum of squared differences between the taxel output and the mean output of all taxels, divided by the number taxels minus one.
- The high-side deviation of taxel outputs. This indicator may be calculated in a similar manner to the standard deviation. In this case, however, only those taxel outputs that exceed the mean taxel output are used in the computation.
- an average value of the outputs for the N taxels having the greatest outputs, wherein N is an integer. N may be in the range of 3 to 7 for example.
- Changes of any of the above indicators relative to the change in air pressure within the chamber (for example a ratio of the change in the indicator to a change in the air pressure).
- rates of change of the above indicators, or combinations thereof.
- Any of the above indicators divided by an average or mean taxel output.
- Any of the above indicators divided by the air pressure in the chamber.
- combinations of the above.

Any of these indicators may be obtained by digitizing the outputs of taxels 30A, providing the results to a data processor or logic circuitry in controller 20 and computing the necessary functions of the outputs of taxels 30A. In the alternative, where taxels 30A produce analog outputs, analog circuitry may be used to generate the desired indicators or to generate functions that may be used to calculate the desired indicators. It is typically more cost effective to digitize the outputs of taxels 30A and to process the outputs in the digital domain than it is to perform extensive processing in the analog domain.

The indicators do not need to consider the specific locations of individual taxels. The indicators may be based upon statistical functions such as sums of taxel values, average taxel values, standard deviation of taxel values or the like that do not require information regarding the locations of individual taxels.

To enhance reliability one can use more than one indicator to detect the onset of a trend toward bottoming out. For example, the inventors have found that the method is more reliable if three or more indicators are used than if the system relies on a single indicator. It is possible to combine a number of indicators, such as two or more of the indicators listed above, in various ways. One such way is to compute a weighted sum of the indicators.

The appropriate threshold values to be used in computing the indicators will vary with the construction of apparatus 10. For example, number of taxels provided by pressure sensor 30, the number and distribution of taxels 30A, the configuration and volume of air chamber 14, the nature of the substrate 34 underlying pressure sensor 30 can all effect the values of the indicators that can be considered to indicate the onset of a trend toward bottoming out. The threshold values can be ascertained empirically for a particular construction of apparatus 10.

Figure 4:
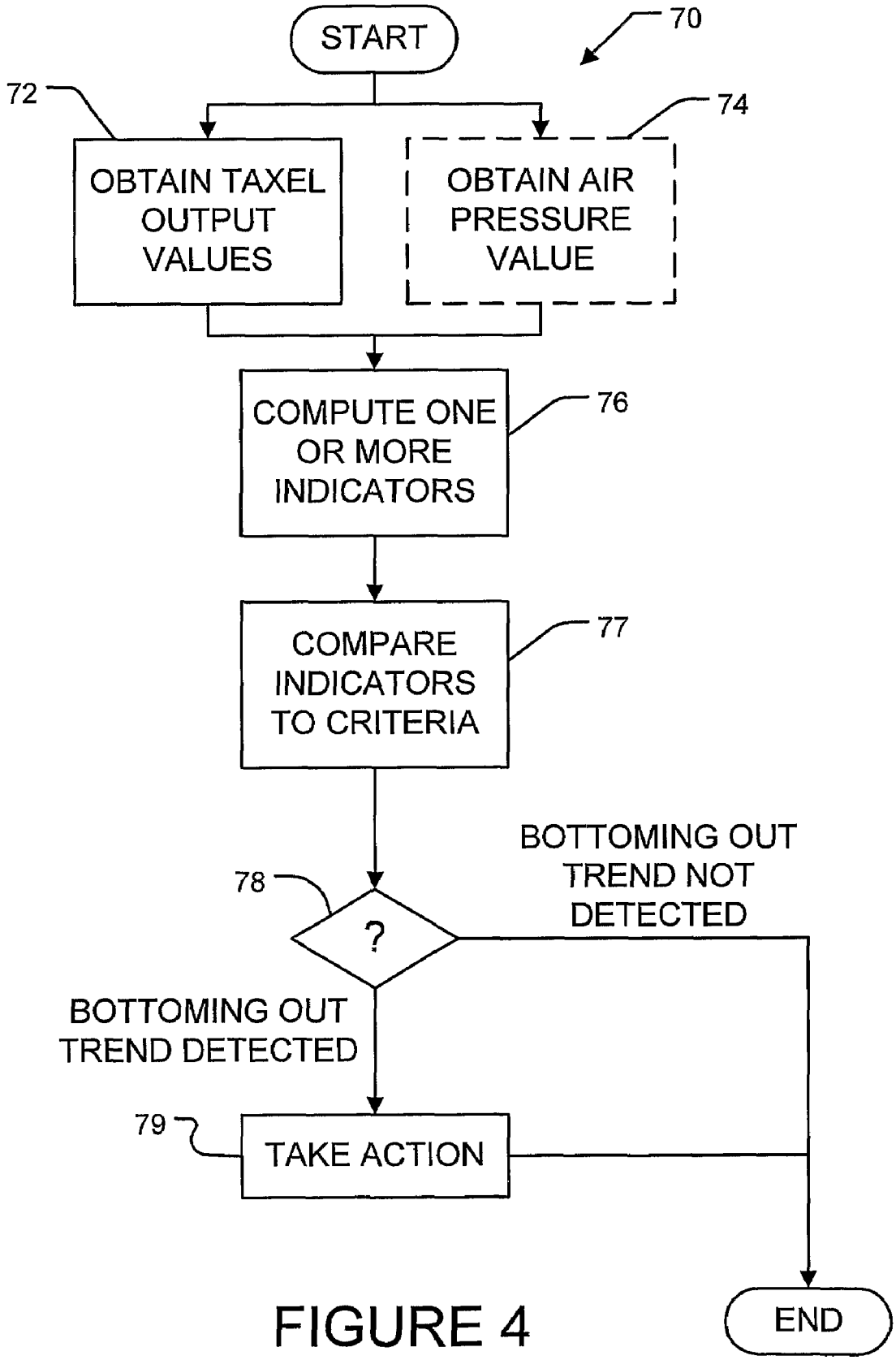
FIG. 4 is a flow chart illustrating a method for detecting the onset of a trend toward bottoming out.

FIG. 4 illustrates a method 70 for detecting the onset of a trend toward bottoming out. Method 70 acquires taxel output values in block 72. If method 70 uses indicators that are based on air pressure in chamber 14 then method 70 acquires an air pressure value indicating the air pressure within chamber 14 in block 74. In block 76 one or more (preferably two or more) indicators are computed from the taxel output values (or the taxel output values and the air pressure value).

In block 77 the indicators are compared to criteria for determining the onset of a trend toward bottoming out. In some embodiments of the invention, the criteria involve changes in the indicators relative to indicators computed for one or more previously-obtained sets of taxel values. For example, the onset of a trend toward bottoming out may be identified by determining that the values of one or more indicators are increasing.

In some embodiments the criteria are dependent upon the pressure within air chamber 14. For example, if the air pressure in chamber 14 is decreasing or is remaining reasonably constant then the indicators may be considered to be reliable indicators of the onset of a trend toward bottoming out. On the other hand, if the air pressure within chamber 14 is increasing then the bottoming out indicators may not be as reliable. In some embodiments, method 70 may determine that a bottoming trend has started only in cases where the air pressure within air chamber 14 is not increasing significantly.

If block 78 does not determine that the indicators indicate that a bottoming out trend has commenced then method 70 ends. Otherwise, if block 78 determines that a bottoming out trend has commenced, method 70 proceeds to block 79 where action can be taken in response to detecting the bottoming-out trend. For example, block 79 may involve controlling a support surface such as apparatus 10 to prevent a bottoming out trend from continuing.

Figure 5:
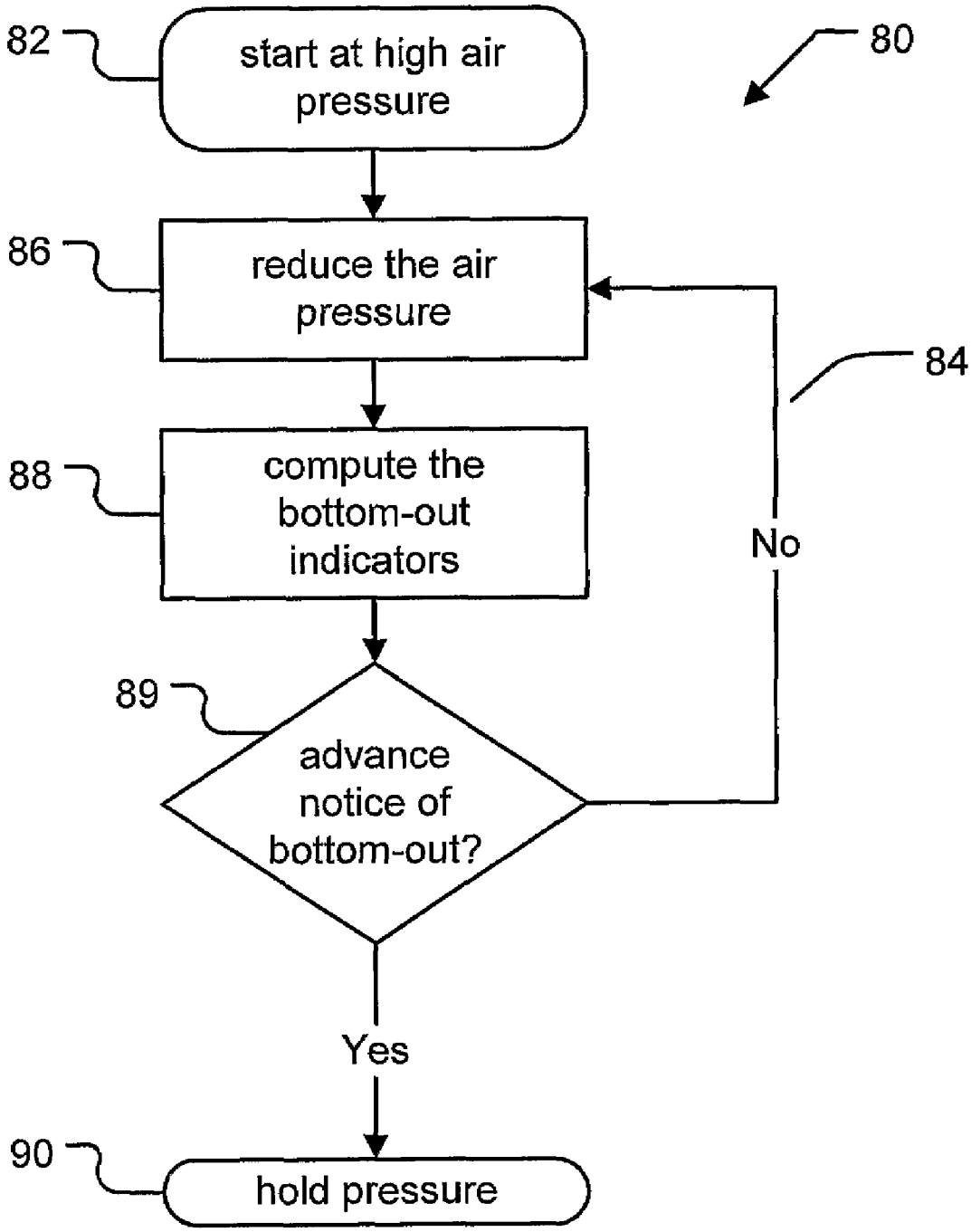
FIG. 5 is a flow chart illustrating a method for controlling air pressure within an air chamber of a support surface.

FIG. 5 shows a method 80 for adjusting the air pressure within an air chamber 14 of a body support. Method 80 begins at block 82 with air chamber 14 inflated to a pressure above the desired pressure. In block 86 the air pressure is reduced by a small amount. Block 86 may involve, for example, opening a valve that vents air from air chamber 14 for a short time. In some embodiments, block 86 involves reducing the pressure of air in air chamber 14 by a predetermined amount.

In block 88, method 80 receives data from pressure sensor 30. One or more bottoming-out indicators are computed from the outputs of taxels 30A. Block 88 may involve performing method 70, for example. If block 89 detects a trend toward bottoming out then the pressure in air chamber 14 is held constant at block 90. In some embodiments, block 90 involves slightly raising the pressure within air chamber 14 and then holding the pressure within air chamber 14 constant.

If block 89 does not identify a trend toward bottoming out then method 80 returns to block 86. Method 80 cycles through loop 84 until it detects the first indication of a trend toward bottoming out. Method 80 then maintains the pressure in block 90 so that the trend toward bottoming out does not become established.

A method like method 80 may be used to provide an automatic system that optimises the interface pressure between a person and a support surface. The optimum pressure is considered to be the point at which the largest surface area of the occupant is supported, coinciding with the lowest peak pressure at any point. This method takes advantage of the ability of method 70 to detect the onset of a trend toward bottoming out before that trend becomes established (i.e. the bottoming-out indicators provide advance notice of bottoming-out). Based on the assumption that the optimum air pressure is the lowest pressure at which a trend toward bottoming-out does not become established, the advance notification provided by method 70 can be used as a signal that the optimum pressure within air chamber 14 has been reached In practice, an automatic control system for controlling the pressure within an air chamber 14 must be able to provide suitable support for a person who is moving, changing position, getting in and out of bed (where the support surface is in a bed), as well as responding to changes in articulation of the bed-frame (where the support surface is in a bed having a frame that can be articulated).

Figure 6:
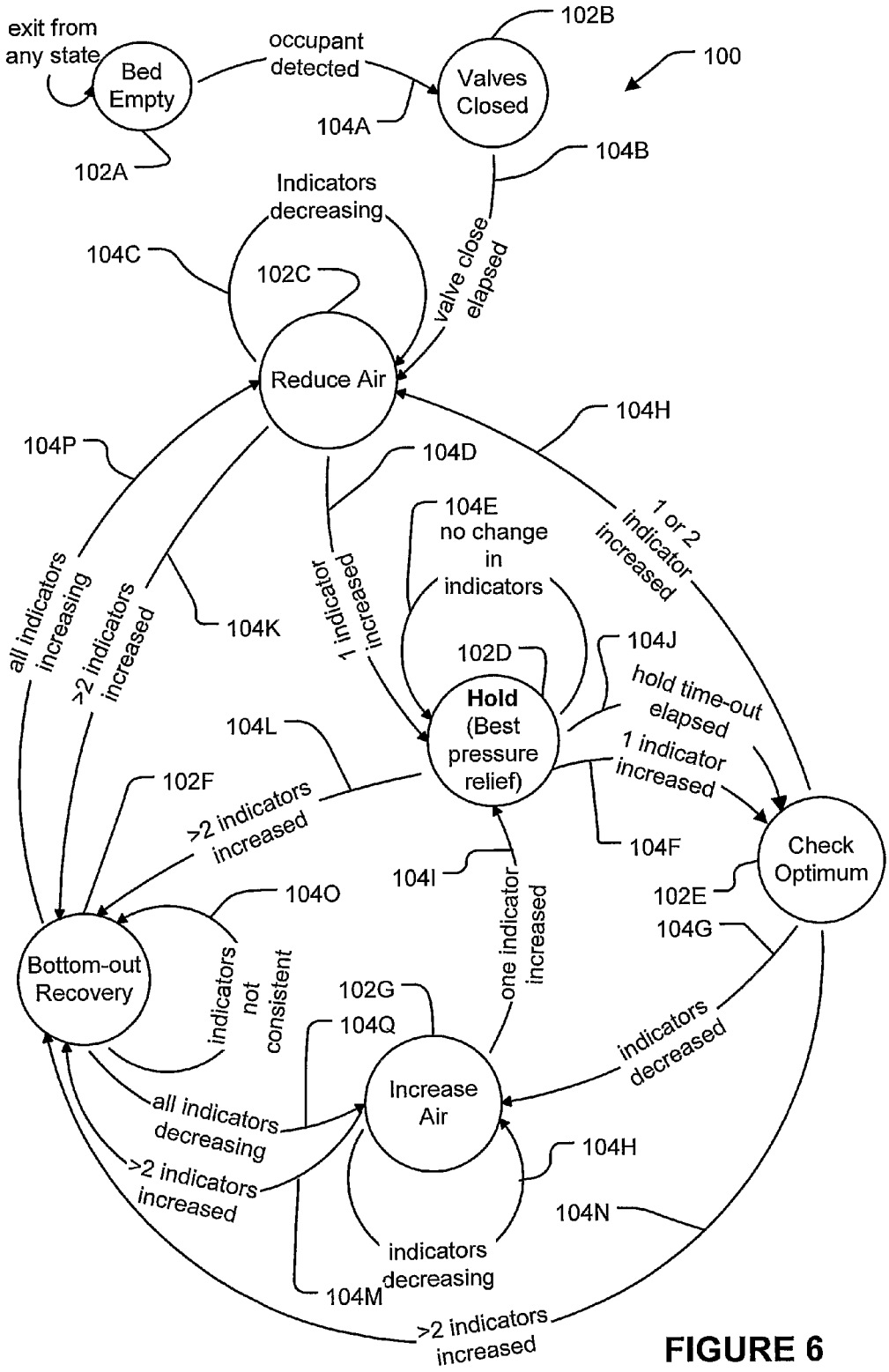
FIG. 6 illustrates states and transitions in a control system implemented by way of a state machine.

FIG. 6 illustrates a control system 100 implemented as a state machine. Control system 100 may comprise a state machine implemented as a software program that executes in a data processor of controller 20. Control system 100 processes pressure distribution data (i.e. taxel values) from the pressure sensor 30, and computes air pressure set-points which are then transmitted to air regulator 16.

Control system 100 provides a number of states 102A through 102G (collectively states 102). States 102 are indicated by circles and transitions between states are indicated by curved arrows 104. The conditions that precipitate a transition from one state 102 to another are labelled on each arrow. Each state 102 may be associated with an action that is performed by control system 100 upon entering the state 102. Once in a state 102 control system 100 monitors for factors that would trigger a transition to some other state 102 and operates in a manner specified for that state 102.

In some cases, the factors that cause a transition are based on a count of the number of indicators meeting a certain condition (e.g. transition 104J occurs when system 100 is in state 102C and ">2 indicators decreasing"). It is to be understood that such conditions may be replaced by comparing a single indicator (or a combination of indicators, such as a weighted sum of indicators) against a suitable threshold.

Control system 100 computes three or more indicators. The indicators are selected such that an increase in the values of the indicators while the air pressure within air chamber 14 is substantially constant or decreasing signifies the onset of a trend toward bottoming out.

FIG. 6 makes reference to a bed, which is one example of a support surface. Control system 100 may be applied equally to chairs, mats and other air-filled support surfaces.

Control system initializes in state 102A in which the bed is empty. In state 102A, the control system sets the air pressure set-point to a value sufficient to fully inflate air chamber 14. For example, the control system may cause the air chamber to be inflated to a pressure on the order of 25 inches of water (about 50 mmHg). When an occupant is detected then control system 100 undergoes transition 104A to "valves closed" state 102B. There are a variety of methods by which it can be determined when a person has entered a bed. For example, transition 104A may be triggered in response to:

- detecting a person by the methods of Lokhorst et al. PCT international Publication No. WO 2004/006768 using an interface pressure sensor;
- detecting the weight of a person my monitoring the output of a load cell or load cells which may be in the legs of the bed frame;
- detecting a person by way of capacitive sensors or other types of bed occupant detection switches; or,
- the like.

In "valves closed" state 102B, control system 100 transmits instructions to air regulator 16 to close off airflow into and out of air chamber 14 (essentially, to stop regulating the air pressure for the time being). After a time period has elapsed, preferably about 5 to 30 seconds, control system 100 undergoes transition 104B into "reduce air" state 102C.

Upon entering "reduce air" state 102C, control system 100 instructs air regulator 16 to reduce the air pressure in air chamber 14 by some increment. After a period of time, the indicators are computed. If the indicators have reduced, then control system 100 reenters "reduce air" state 102C as indicated by transition 104C and initiates another decrement to the air pressure. If one indicator or two indicators are found to have increased, then it means that a bottoming-out trend has started. Control system switches to "hold" state 102D by transition 104D.

In "hold" state 102D, control system 100 instructs air regulator 16 to maintain air pressure in chamber 14 at the value it was when the state was entered. Periodically, the indicators are computed. If there is no significant change in indicators 104D, then the automatic control system remains in "hold" state 102D.

If one indicator increases while control system 100 is in the "hold" state, it may be indicative of the occupant moving. In that case it is desirable to conduct a test to determine if the air pressure presently being maintained in air chamber 14 is optimal. Control system 100 causes this test to be performed by providing a transition 104F to check optimum state 102E upon determining that one indicator is increasing.

In "check optimum" state 102E, control system 100 instructs air regulator 16 to increment the air pressure in air chamber 14 by some amount. After the desired increase in air pressure has been achieved (or, alternatively, after a reasonable length of time has elapsed), the indicators are computed. A decrease in the indicators indicates that another increment in air pressure is required. Upon detecting a decrease in the indicators, control system 100 undergoes transition 104G to "Increase Air" state 102G. To understand this, recall that the indicators in this example are chosen so that they reach their minimum values at or about the optimum air pressure just prior to bottoming-out. Therefore, when the indicators decrease with increasing air pressure, then it indicates that the air pressure is still too low—further increasing the air pressure is likely to further reduce the indicators.

If, when control system is in state 102E, the indicators generally increase after the increment in air pressure, then control system 100 undergoes transition 104H to "reduce air" state 102C because the increase in the indicators shows that the air pressure in air chamber 14 is higher than optimum.

In "increase air" state 102G, control system 100 instructs air regulator 16 to increase the air pressure in air chamber 14 by some increment. After a period of time, the indicators are computed. If the indicators have reduced then control system 100 undergoes transition 104H and reenters increase air state 102G. If one or two indicators are found to have increased, then it means that the bottoming-out trend has been averted, and the automatic control system undergoes transition 104I to "hold" state 102D.

In normal operation, control system 100 moves between states 102C, 102D, 102E and 102G by way of the transitions described above. To ensure proper function of system 100 it is desirable to provide an additional transition 104J between "hold" state 102D and "check optimum" state 102E. As an example of why this is desirable, consider the case where a bed occupant moves while system 100 is in "reduce air" state 102C. Such a movement may cause one or more indicators to increase (where otherwise they would have continued to decrease), incorrectly causing system 100 to switch into the "hold" state. For this reason, it is preferable to set a limit on the length of time that the system remains in the "hold" state. When the time has elapsed, the system undergoes transition 104J to "check optimum" state 102E.

It is preferable to make the time limit (the hold time-out) variable. The first time that "hold" state 102D is entered since control system 100 is initialized, the time limit may be quite short, perhaps only a few seconds. When system 100 subsequently enters a "hold" state (after cycling through the "check optimum" and "reduce" air states), if the air pressure is similar to the last air pressure while in "hold" state, then the hold time-out may be set to a larger value, perhaps several minutes or even hours in length.

In practice, events may occur that necessitate switching control system 100 into additional "bottom-out recovery" state 102F. For example, it also happens occasionally that the occupant may move in a manner that causes air chamber 14 to bottom-out. For example, a bed occupant who is initially lying down may sit up. Although the air pressure in air chamber 14 may have been sufficient to stably support the occupant while lying, the air pressure may be insufficient to stably support the occupant in a seated position. Thus, when the occupant sits up, air chamber 14 may tend to collapse and bottoming-out may occur.

In general, when bottoming-out occurs, the indicators will increase steeply. The inventors have seen that it is easy to discriminate between the slight increase in indicators that indicates the onset of a trend toward bottoming-out and the steep sudden increase in several indicators that indicates an actual bottom-out event. Therefore, if, in any of the "reduce air" 102C, "hold" 102D, "check optimum" 102E, or "increase air" 102G states, more than two of the indicators increase, system 100 assumes that a bottom-out event has occurred, and control system 100 undergoes a transition 104K, 104L, 104M, 104N to "bottom-out recovery" state 102F.

In "bottom-out recovery" state 102F, control system 100 instructs air regulator 16 to increase the air pressure in air chamber 14 by some increment. After a period of time, the indicators are computed. If the indicators are not consistent with each other (i.e. some are increasing, others decreasing) then system 100 undergoes transition 104O and reenters "bottom-out recovery" state 102F. Inconsistent indicators indicate that the system is still bottomed-out. Upon reentering state 102F, system 100 increments the air pressure set-point again.

If system 100 is in state 102F and all the indicators are increasing, then the system has recovered from bottoming-out and the bottoming-out trend has been averted. In this case, control system 100 undergoes transition 104P to "reduce air" state 102C.

If system 100 is in state 102F and all of the indicators are decreasing, it indicates that the system has recovered from bottoming-out, but that the bottoming-out trend has not yet been averted. In this case, system 100 undergoes transition 104Q to "increase air" state.

Control system 100 may be made to operate stably by controlling the conditions under which transitions can occur. For example, in the illustrated embodiment, there are no direct transitions between "Reduce Air" state 102C and "Increase Air" state. This avoids unstable behaviour (as evidenced by the system oscillating between those states). It is desirable to provide a transition (not shown) by way of which system 100 undergoes a transition from "increase air" state 102G to "reduce air" state 102C upon detecting a maximum pressure or overpressure condition in air chamber 14.

Figure 6A:
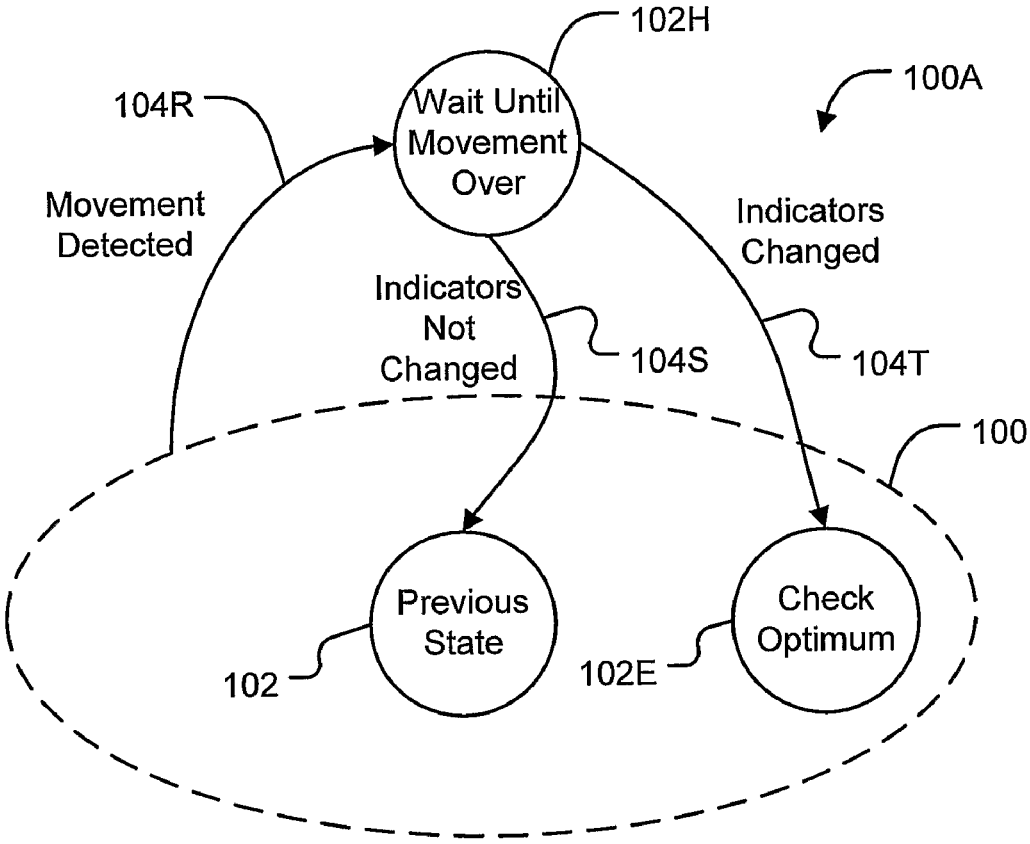
FIG. 6A is a modification to the control system of FIG. 6 that may be provided to compensate for motion.

Especially in applications where a body support will be used in a vehicle or other that is susceptible to movement or in cases where a person being supported is active, it may be desirable to modify control system 100 to detect and compensate for movements that could otherwise affect the operation of control system 100. FIG. 6A illustrates an enhancement 100A to control system 100 of FIG. 6. In motor vehicle applications, aircraft applications, or other moving applications, sudden motion of the vehicle may cause the interface pressure distribution to vary, thereby causing the indicators to vary. It is possible in such instances that control system 100 may respond by changing states. This could be undesirable in a situation where the there is ongoing disturbance (eg. turbulence in an aircraft).

FIG. 6A shows a control system 100A that includes an additional state 102G. If movement is detected (i.e. the interface pressure distribution detected by pressure sensor 30 varies widely and/or rapidly or, in addition or in the alternative, motion is detected by an accelerometer or other motion sensor (not shown)) while in any other state 102, control system 100A undergoes a transition 104R to the "wait until movement over" state 102G. It should be understood that transition 104R represents a bundle of possible transitions, one from each state 102 of control system 100 to state 102G.

When control system enters state 102G, air regulator 16 is controlled to isolate air chamber 14 (e.g. by closing inlet or inlet and outlet valves). While in state 102G, control system 100A does not regulate pressure in air chamber 14. Control system remains in state 102G until the motion has subsided for a prescribed period of time, preferably a few seconds.

When the prescribed time has elapsed since motion was last detected, the indicators are computed. The indicator values are compared to stored values that the indicators had prior to control system 100A undergoing transition 104R. If the indicators have not changed significantly from the values they had prior to motion being detected, then control system 100A undergoes transition 104S which takes it back into the state 102 that it was in prior to motion being detected. If the indicators have changed significantly (e.g. the indicators have changed by an amount that exceeds a set tolerance that may be, for example, in the range of 5%-20%) then control system 100A undergoes transition 104T which takes in into "check optimum" state 102E.

It can be appreciated that support surfaces and their associated control systems and mechanisms have a wide range of application including:

Motor vehicle seats—especially seats in long-haul trucks, buses, construction equipment, mining equipment, where the driver and/or passengers remain seated for extended periods of time.

Aircraft seats—in this application, weight is of critical importance, and there is significant reduction in weight of the seat if air chambers can be used instead of foam.

Wheelchairs—occupants of wheel chairs are susceptible to pressure sores, and this invention provides a means of reducing the likelihood of pressure sores from developing.

Beds—long term care and acute care, especially where the occupant is immobile (due to medication, illness, or age) and therefore at risk of developing pressure sores.

Chairs—especially where people remain seated for extended periods of time (e.g. Office chairs).

Figure 7:
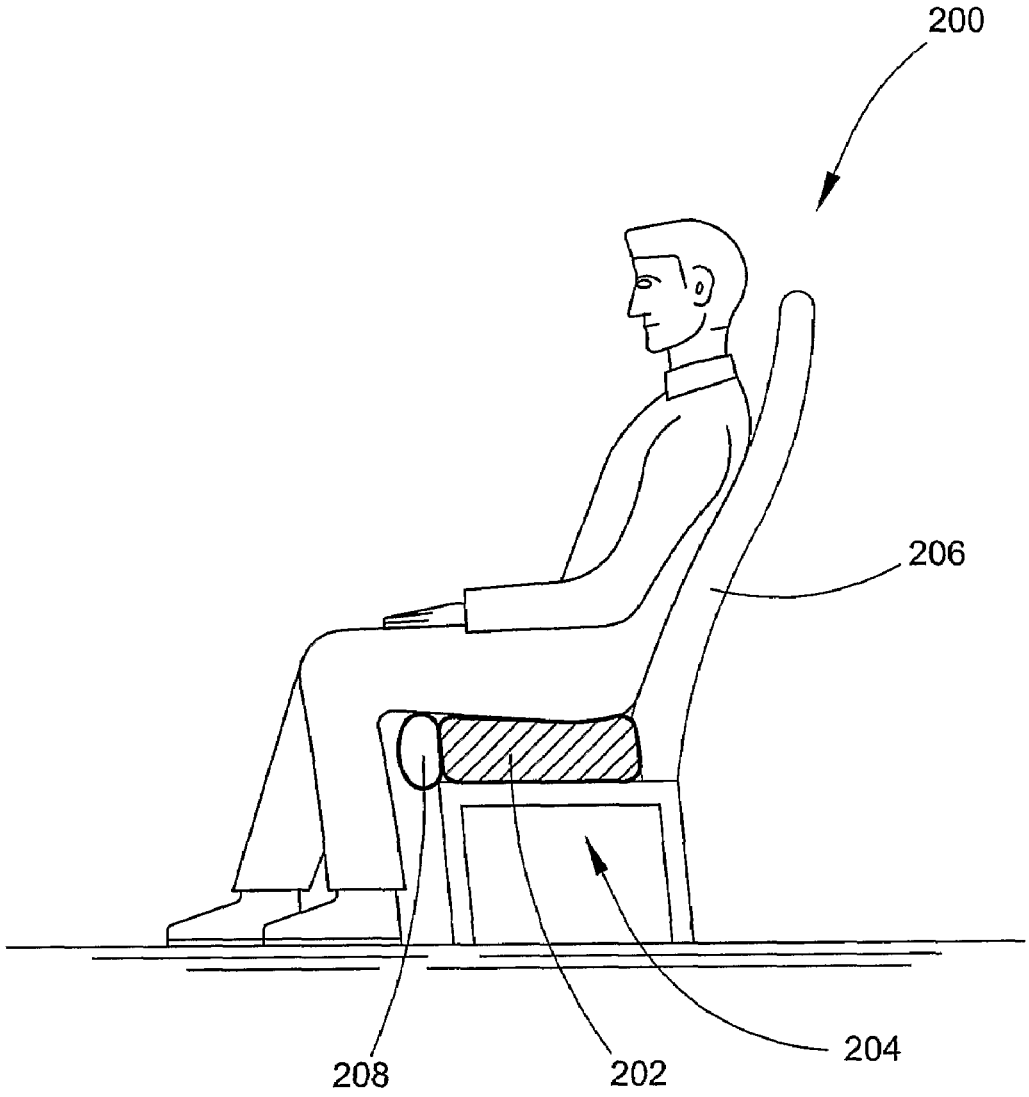
FIG. 7 is a schematic cross-section view of a chair.

As an example of the range of applications of the body supports described herein, FIG. 7 shows a chair 200. Chair 200 may be a motor vehicle seat, aircraft seat, or regular furniture. An air chamber 202 is located in the main seat support area 204 between a seat back 206 and a bolster 208. Bolster 208, may be on the front only, sides only, or front and sides of air chamber 202. Bolster 208 helps to maintain the shape of the air chamber and provide some mechanical stability to the air chamber. Bolster 208 may be made of a suitable foam material, for example. A control system as described herein may be provided to control the pressure of air within air chamber 202.

Figure 8:
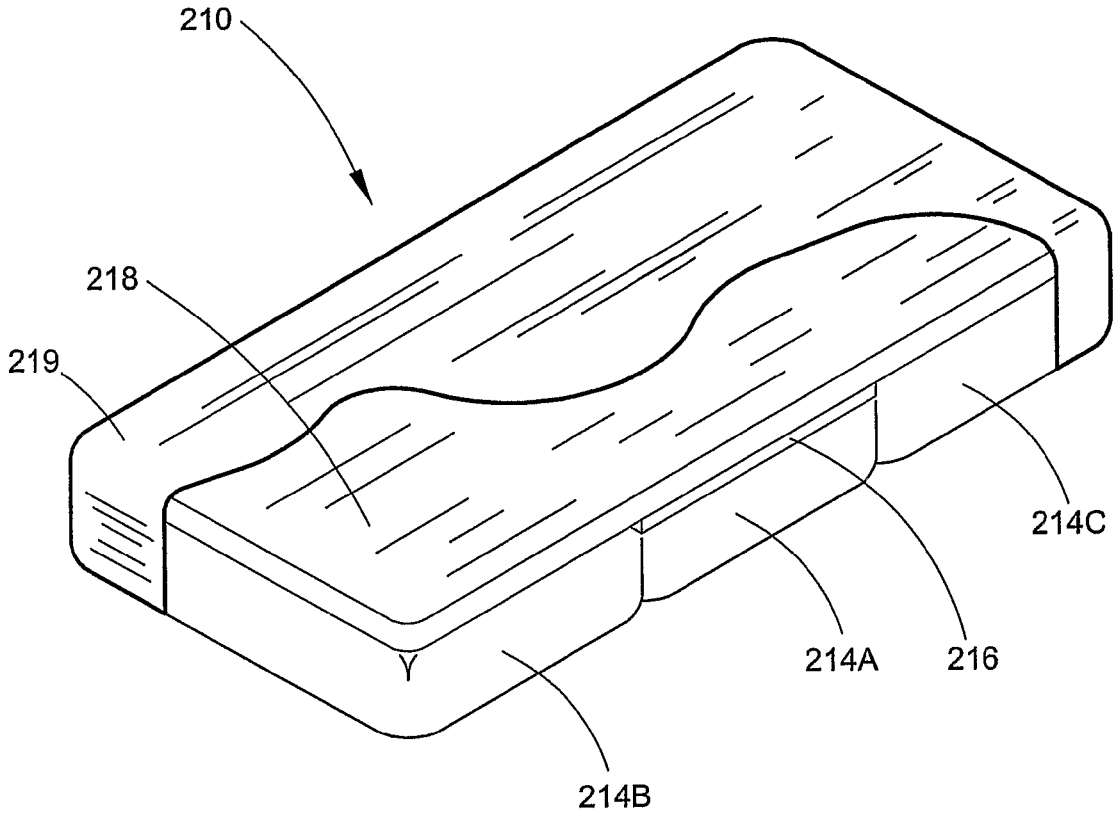
FIG. 8 is a perspective view of a mattress having a pressure sensor is located on top of an air chamber.

It can be appreciated that a support surface and controller for a support surface may be varied in numerous ways while preserving the basic function of providing support. In one such variation, a pressure sensor is disposed between air chamber 14 and a body being supported. FIG. 8 shows a mattress 210 which is similar to mattress 10A of FIG. 1A. Mattress 210 has three air chambers 214A, 214B, and 214C. An interface pressure sensor 216 is provided on top of first air chamber 214A beneath a flexible top layer 218. A cover 219 wraps around the outside of mattress 210.

Top layer 218 is optional and is preferably of a low-density foam material. Mattress 210 does not require a substrate except as may be necessary to properly support air chambers 14 on a bed frame. In this configuration, pressure sensor 216 is necessarily flexible.

Certain implementations of the invention comprise computer processors which execute software instructions which cause the processors to perform a method of the invention. For example, one or more processors in a controller for a support surface may implement the methods of FIGS. 4 and 5 or the functions of the control system of FIGS. 6 and 6A by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like or transmission-type media such as digital or analog communication links. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

While some of the body supports described above include a single air chamber, a body support may have multiple air chambers each having a pressure controlled as described herein. The multiple air chambers may be disposed on a single pressure sensor that provides a two-dimensional distribution of taxels under each of the air chambers. In the alternative, separate pressure sensors may be provided for each of the air chambers.

An air chamber may be segmented into different regions that are in fluid communication with one another but are interconnected in a manner that limits the rate at which air can flow between them. For example, the regions may be separated by porous walls or by passages that include narrow orifices.

The support surface may comprise any number of additional layers. The layers may be foam, air chambers, or other flexible materials. The pressure sensor may be placed in-between any two layers in the support surface.

The outputs of taxels 30A may be used to derive additional information such as: information regarding the position of a person on the support surface; the weight of a person lying on the support surface; an indication that a person has moved off of the support surface; an indication that a person on the support surface has ceased moving for a period of time; and the like. This additional information may be provided by way of a user interface of controller 20 for example.

A support surface may be made up of a frame assembly, such as a bed frame or chair frame, that incorporates a pressure sensor 30 and a cushion assembly comprising at least one air chamber 14 that can be disposed atop the frame assembly. The frame assembly and cushion assembly may be supplied separately.

A support surface according to the invention could be filled with a liquid, such as a water, for example, instead of air or another gas. In this case, instead of regulating gas pressure within an air chamber, the system could regulate the pressure of the liquid in the chamber. The chamber could also be filled partly with a liquid and partly with a gas. In this disclosure the term "fluids" incorporates both liquids and gases.

Accordingly, the scope of the invention is to be construed in accordance with the substance defined by the following claims.

What is claimed is:

1. A sensor apparatus for a body support surface including an inflatable air chamber, the apparatus comprising:

a plurality of pressure-sensitive taxels underlying an air chamber of a body support surface, each of the taxels providing an output indicative of a pressure exerted by the air chamber on a substrate underlying the air chamber at a location of the taxel; and a controller: that is connected to receive the outputs of the taxels; that comprises a state machine having a plurality of defined states and a plurality of transitions defined between the states; and that derives a plurality of bottoming out indicators from the taxel outputs, each of the bottoming out indicators indicating a degree of non-uniformity in the outputs of the taxels;

wherein, for at least one of the states:

the state machine undergoes a first transition if a first number of the plurality of bottoming out indicators indicates a trend toward bottoming out; and the state machine undergoes a second transition if a second number of the plurality of bottoming out indicators that is greater than the first number indicates a trend toward bottoming out.

2. A sensor apparatus according to claim 1 wherein the controller is configured to:

automatically monitor the air chamber until the onset of a trend toward bottoming out is detected.

3. A sensor apparatus according to claim 1 wherein the controller is configured to compute a sum of the outputs of those of the taxels having values greater than a high-pressure threshold.

4. A sensor apparatus according to claim 1 wherein the controller is configured to identify those of the taxels having values greater than a high-pressure threshold, and compute a sum of the amounts by which the outputs exceed the high-pressure threshold.

5. A sensor apparatus according to claim 1 wherein the controller is configured to determine a number of the taxels for which the outputs of the taxels have values lower than a low-pressure threshold.

6. A sensor apparatus according to claim 1 wherein the controller is configured to compute a measure of variance of values of the outputs of the taxels.

7. A sensor apparatus according to claim 1 wherein the controller derives at least three different bottoming out indicators from the taxel outputs.

8. A sensor apparatus according to claim 7 wherein the three different bottoming out indicators include a measure of variance of the outputs of the taxels.

9. A sensor apparatus according to claim 7 wherein the three different bottoming out indicators include an indicator based at least in part on a sum of the amounts by which the taxel outputs exceed a threshold.

10. A sensor apparatus according to claim 7 wherein the three different bottoming out indicators include an indicator based at least in part on an average value of the outputs for the N taxels having the greatest outputs, wherein N is an integer.

11. A sensor apparatus comprising:

a plurality of pressure-sensitive taxels distributed over a two-dimensional area to sense an interface pressure exerted by an inflatable air chamber, each of the taxels providing an output indicative of a pressure exerted by the air chamber at the location of the taxel; and, a controller: that is connected to receive the outputs of the taxels; that comprises a state machine having a plurality of defined states and a plurality of transitions defined between the states; and that derives a plurality of bottoming out indicators from the taxel outputs, each of the bottoming out indicators indicating a degree of non-uniformity in the outputs of the taxels;

wherein for at least one of the states:

the state machine undergoes a first transition if a first number of the plurality of bottoming out indicators indicates a trend toward bottoming out; and the state machine undergoes a second transition if a second number of the plurality of bottoming out indicators that is greater than the first number indicates a trend toward bottoming out.

12. A sensor apparatus according to claim 11 wherein the controller is configured to:

monitor the outputs of the taxels to identify the onset of a trend toward bottoming out.

13. A sensor apparatus according to claim 12 wherein monitoring the outputs of the taxels to identify the onset of a trend toward bottoming out comprises computing a sum of the outputs of those of the taxels having output values greater than a high-pressure threshold.

14. A sensor apparatus according to claim 12 wherein monitoring the outputs of the taxels to identify the onset of a trend toward bottoming out comprises, for those of the taxels having values greater than a high-pressure threshold, computing a sum of the amounts by which the outputs exceed the high-pressure threshold.

15. A sensor apparatus according to claim 12 wherein monitoring the outputs of the taxels to identify the onset of a trend toward bottoming out comprises determining a number of the taxels for which the outputs of the taxels have values lower than a low-pressure threshold.

16. A sensor apparatus according to claim 12 wherein monitoring the outputs of the taxels to identify the onset of a trend toward bottoming out comprises computing a measure of variance of values of the outputs of the taxels.

17. A sensor apparatus according to claim 11 wherein the controller derives at least three different bottoming out indicators from the taxel outputs.

18. A sensor apparatus according to claim 11 wherein the controller computes a measure of variance of the outputs of the taxels and derives a bottoming-out indicator from the measure of variance.

19. A sensor apparatus according to claim 17 wherein the three different bottoming out indicators include an indicator based at least in part on a sum of the amounts by which the taxel outputs exceed a threshold.

20. A sensor apparatus according to claim 17 wherein the three different bottoming out indicators include an indicator based at least in part on an average value of the outputs for the N taxels having the greatest outputs, wherein N is an integer.

21. A method for monitoring gas pressure within an air chamber of a body support surface, the method comprising:

monitoring interface pressures of the air chamber at a plurality of spaced-apart locations of pressure-sensitive taxels underlying an air chamber of a body support surface, each of the taxels providing an output indicative of a pressure exerted by the air chamber on a substrate underlying the air chamber at a location of the taxel; and, deriving a plurality of bottoming out indicators from the taxel outputs, each of the bottoming out indicators indicating a degree of non-uniformity in the outputs of the taxels;

wherein a first transition is undergone if a first number of the plurality of bottoming out indicators indicates a trend toward bottoming out, the first transition being one of a plurality of transitions defined between a plurality of defined states; and a second transition is undergone if a second number of the plurality of bottoming out indicators that is greater than the first number indicates a trend toward bottoming out, the second transition being one of the plurality of transitions.

22. A method according to claim 21 wherein monitoring for a trend toward bottoming out comprises monitoring for an increase in maximum values of the interface pressures coupled with an increase in number of the interface pressures that have values below a low-pressure threshold.

23. A method according to claim 22 wherein monitoring for an increase in maximum values of the interface pressures comprises computing a sum of those of the interface pressures having values greater than a high-pressure threshold.

24. A method according to claim 21 comprising computing a measure of variance of values of the interface pressures.

* * * * *